US006094638A

United States Patent [19]

Ema et al.

[11] Patent Number: 6,094,638

[45] Date of Patent: Jul. 25, 2000

[54] AUDIO SIGNAL PROCESSING APPARATUS AND AUDIO SIGNAL PROCESSING METHOD FOR MULTI CHANNEL AUDIO REPRODUCTION SYSTEM

[75] Inventors: Shozo Ema; Hirokazu Inotani, both of Tokorozawa; Takao Sawabe, Tokyo-to; Yoshinori Hasegawa; Hidehiro Ishii, both of Tokorozawa; Kaoru Yamamoto, Tsurugashima; Tokihiro Takahashi, Kawagoe, all of Japan

[73] Assignee: Pioneer Electronic Corporation, Tokyo-to, Japan

[21] Appl. No.: 09/129,420

[22] Filed: Aug. 5, 1998

[30] Foreign Application Priority Data

Aug. 7, 1997 [JP] Japan ..... P09-212946

[51] Int. Cl.[7] ..... G10L 21/04

[52] U.S. Cl. ..... 704/502; 704/503

[58] Field of Search ..... 704/200, 201, 704/500, 501, 502, 270; 381/80, 307

[56] References Cited

U.S. PATENT DOCUMENTS 5,530,750 6/1996 Akagiri ..... 380/4

5,740,144 4/1998 Kimura et al. ..... 369/60

5,844,513 12/1998 Nishio ..... 341/143

5,999,511 12/1999 Jeon ..... 369/124

*Primary Examiner*—Richemond Dorvil

*Attorney, Agent, or Firm*—Morgan, Lewis & Bockius LLP

[57] ABSTRACT

An audio signal processing apparatus performs digital-to-analog conversion to convert at least a first audio data signal having a first sampling frequency and a second audio data signal having a second sampling frequency which is different from the first sampling frequency into corresponding analog audio signals, respectively. The audio signal processing apparatus is provided with: a frequency converting device for converting the second sampling frequency of the second audio data signal into the same sampling frequency as the first sampling frequency; a digital-to-analog converting device for performing digital-to-analog conversion to convert the first audio data signal having the first sampling frequency and the second audio data signal having the converted second sampling frequency which is the same as the first sampling frequency into the analog audio signals, respectively.

10 Claims, 6 Drawing Sheets

AUDIO SIGNAL PROCESSING APPARATUS AND AUDIO SIGNAL PROCESSING METHOD FOR MULTI CHANNEL AUDIO REPRODUCTION SYSTEM

BACKGROUND OF THE INVENTION

1. Field of the Invention

The present invention relates generally to an audio signal processing apparatus and an audio signal processing method for a multi channel audio reproduction system, more particularly to an apparatus for allowing conversion from a plurality of digital audio signals having different sampling frequencies into analog audio signals.

2. Description of the Related Art

For instance, digital audio signals including information with respect to sound and voice are recorded on a DVD or the like as digital audio signals. The term DVD is to be broadly interpreted to include, but is not limited to, Digital Versatile Disk, Digital Video Disk, and the like, and their equivalents. A DVD reproduction system reads the digital audio signals from the DVD, converts the digital audio signals into the corresponding analog audio signals by using a digital-to-analog converting circuit (DA converter) installed therein, and feeds the analog audio signals to the speakers or the like.

A variety of DVD reproduction systems are developed. Among such DVD reproduction systems, there is a DVD reproduction system which adopts a multi channel audio reproduction method. The multi channel audio reproduction method is a method of delivering audio signals to more than two channels. In such a DVD reproduction system, audio signals are delivered to, for example, six channels, such as the center front, the left front, the right front, the center back, the left back and the right back.

Generally, in such a DVD reproduction system which adopts the multi channel audio reproduction method, all of the audio signals delivered to the respective channels have the same sampling frequency. For example, in case that the sound of movies or motion pictures recorded on the DVD are reproduced by using a DVD reproduction system having six channels, all of the six audio signals delivered to the respective six channels have the same sampling frequency of 48 kHz.

In general, if the sampling frequency of an audio signal is increased, the quality of the sound reproduced by a DVD reproduction system is enhanced. For example, in the DVD reproduction system having six channels, if the sampling frequencies of all the six audio signals are increased from 48 kHz to 96 kHz, the sound quality is enhanced. However, if the sampling frequencies of all the six audio signals are increased, the amount of the audio signals, that is, the amount of data necessary for reproducing the sound is largely increased. In consideration of limitation of the capacity of the DVD and limitation of the data transfer rate with respect to the audio signals, increase in the amount of the audio signals is undesirable.

In case of the DVD reproduction system having six channels, in order to restrict the increase in the amount of the audio signals, it is preferable to increase the sampling frequencies with respect to only some of the six channels, for example, three channels, from 48 kHz to 96 kHz.

Generally, when listening to the music or the sound of the movie, listener's attention is focused on the sound coming from the front as compared with the sound coming from the back. In case of the DVD reproduction system having six channels corresponding to the center front, the left front, the right front, the center back, the left back and the right back, the sampling frequencies of the audio signals to be delivered to the three front channels, i.e., the center front, the left front and the right front, are set at 96 kHz, and the sampling frequencies of the audio signals to be delivered to the three back channels, i.e., the center back, the left back and the right back, are set at 48 kHz. Thus, the increase in the amount of the audio signals can be restrict, while enhancing the overall sound quality of music and movies.

As discussed above, in order to restrict the increase in the amount of the audio signals, it is preferable that the sampling frequencies of the audio signals delivered to the respective channels are set at two kinds of values, for example, 48 kHz and 96 kHz.

However, if the sampling frequencies of the audio signals are set at two kinds of values, two kinds of digital-to-analog converting circuits are required. For example, a digital-to-analog converting circuit to convert the digital audio signal having the sampling frequency of 48 kHz into the analog audio signal and a digital-to-analog converting circuit to convert the digital audio signal having the sampling frequency of 96 kHz into the analog audio signal are required. As a result, the structure of circuits in the DVD reproduction system becomes complex, and manufacturing cost of the DVD reproduction system is increased. For example, the number of signal lines to be used for controlling the respective digital-to-analog converting circuits is increased. Further, in case that multi channel type digital-to-analog converting chips, such as dual channel type digital-to-analog converting chips are used as the digital-to-analog converting circuits, the number of the chips is increased.

SUMMARY OF THE INVENTION

It is therefore an object of the present invention to provide an audio signal processing apparatus and an audio signal processing method for a multi channel audio reproduction system, which can simplify the structure and reduce the manufacturing cost.

According to the present invention, the above mentioned object can be achieved by an audio signal processing apparatus for performing digital-to-analog conversion to convert at least a first audio data signal having a first sampling frequency and a second audio data signal having a second sampling frequency which is different from the first sampling frequency into corresponding analog audio signals, respectively, the audio signal processing apparatus having: a frequency converting device for converting the second sampling frequency of the second audio data signal into the same sampling frequency as the first sampling frequency; and a digital-to-analog converting device for performing digital-to-analog conversion to convert the first audio data signal having the first sampling frequency and the second audio data signal having the converted second sampling frequency into the analog audio signals, respectively.

By converting the second sampling frequency of the second audio data signal into the same sampling frequency as the first sampling frequency, it is possible to make the sampling frequencies of the first audio data signal and the second audio data signal uniform. Therefore, it is possible to convert both of the first audio data signal and the second audio data signal into the corresponding analog audio signals, respectively, by using only one kind of digital-to-analog converting device.

For example, in case that the audio signal processing apparatus is used in a multi channel audio reproduction system, the audio signal processing apparatus must convert a plurality of (at least more than two) audio data signals into analog audio signals. Therefore, a digital-to-analog converting device capable of converting the plurality of audio signals to the analog audio signals are needed. In order to produce such a digital-to-analog converting device, a plurality of digital-to-analog converting elements, such as digital-to-analog converting circuits, digital-to-analog converting chips and the like, are needed. In this case, according to the present invention, all the audio data signals can be converted into the analog audio signals by using only one kind of digital-to-analog converting element. Consequently, it is possible to simplify the structure of the digital-to-analog converting device, and reduce the manufacturing cost.

Further, the audio signal processing apparatus may have a delay device for delaying the first audio data signal by a time period necessary for the frequency converting device to convert the second sampling frequency of the second audio data signal into the same sampling frequency as the first sampling frequency. Thus, it is possible to set the first audio data signal and the second audio data signal in phase, and therefore, enhance the sound quality.

Moreover, in case that the first sampling frequency is higher than the second sampling frequency, the frequency converting device raises the second sampling frequency to equalize the second sampling frequency to the first sampling frequency. Therefore, it is possible to improve signal to noise ratio of the second audio data signal, and thus, enhancing the sound quality.

Furthermore, the digital-to-analog converting device may have: a control signal generating device for generating a control signal which indicates a length of each data included in each of the first audio data signal and the second audio data signal; and a digital-to-analog converter for performing digital-to-analog conversion to convert the first audio data signal and the second audio data signal into the analog audio signals, respectively, on the basis of the control signal.

When converting the audio data signals into the analog audio signals, the digital-to-analog converter recognizes the length of each data included in each audio data signal. Therefore, in the audio signal processing apparatus, the control signal which indicates the length of each data included in each of the first audio data signal and the second audio data signal is generated and applied to the digital-to-analog converter.

For example, in case that the audio signal processing apparatus is used in a multi channel audio reproduction system, it is required to install a plurality of digital-to-analog converting elements in the digital-to-analog converter in order to convert a plurality of audio data signals into analog audio signals. Further, it is required to apply the control signal to each of the digital-to-analog elements in order to control each of the digital-to-analog elements.

In this case, according to the present invention, since all the audio data signals can be converted into the analog audio signals by using one kind of digital-to-analog converting element, it is possible to control all the digital-to-analog elements by the common control signal. Accordingly, it is possible to simplify the structure of the audio signal processing apparatus.

Alternatively, the digital-to-analog converting device may have: a digital signal generating device for generating a digital signal by mixing the first audio data signal and the second audio data signal and generating a control signal which includes information to divide the digital signal into two components corresponding to the first audio data signal and the second audio data signal; and a digital-to-analog converter for dividing the digital signal into the two components on the basis of the control signal and performing digital-to-analog conversion to convert the two components into the analog audio signals, respectively.

In such a construction, the control signal is applied to the digital-to-analog converter. For example, in case that the audio signal processing apparatus is used in a multi channel audio reproduction system, it is necessary to install a plurality of digital-to-analog converting elements in the digital-to-analog converter and it is necessary to apply the control signal to each of the digital-to-analog elements in order to control each of the digital-to-analog elements. In this case, according to the present invention, since all the audio data signals can be converted into the analog audio signals by using one kind of digital-to-analog converting element, it is possible to control all the digital-to-analog elements by the common control signal. Accordingly, it is possible to simplify the structure of the audio signal processing apparatus.

According to the present invention, the above mentioned object can be also achieved by an audio signal processing method of performing digital-to-analog conversion to convert at least a first audio data signal having a first sampling frequency and a second audio data signal having a second sampling frequency which is different from the first sampling frequency into corresponding analog audio signals, respectively, the audio signal processing method having the processes of: converting the second sampling frequency of the second audio data signal into the same sampling frequency as the first sampling frequency; and performing digital-to-analog conversion to convert the first audio data signal having the first sampling frequency and the second audio data signal having the converted second sampling frequency into the analog audio signals, respectively.

The nature, utility, and further feature of this invention will be more clearly apparent from the following detailed description with respect to preferred embodiments of the invention when read in conjunction with the accompanying drawings briefly described below.

DETAILED DESCRIPTION OF THE PREFERRED EMBODIMENTS

Referring to the accompanying drawings, embodiments of the present invention will be now explained.

First, an audio signal processing apparatus for a multi channel audio reproduction system according to a first embodiment of the present invention is explained with reference to FIGS. 1 and 2.

Figure 1:
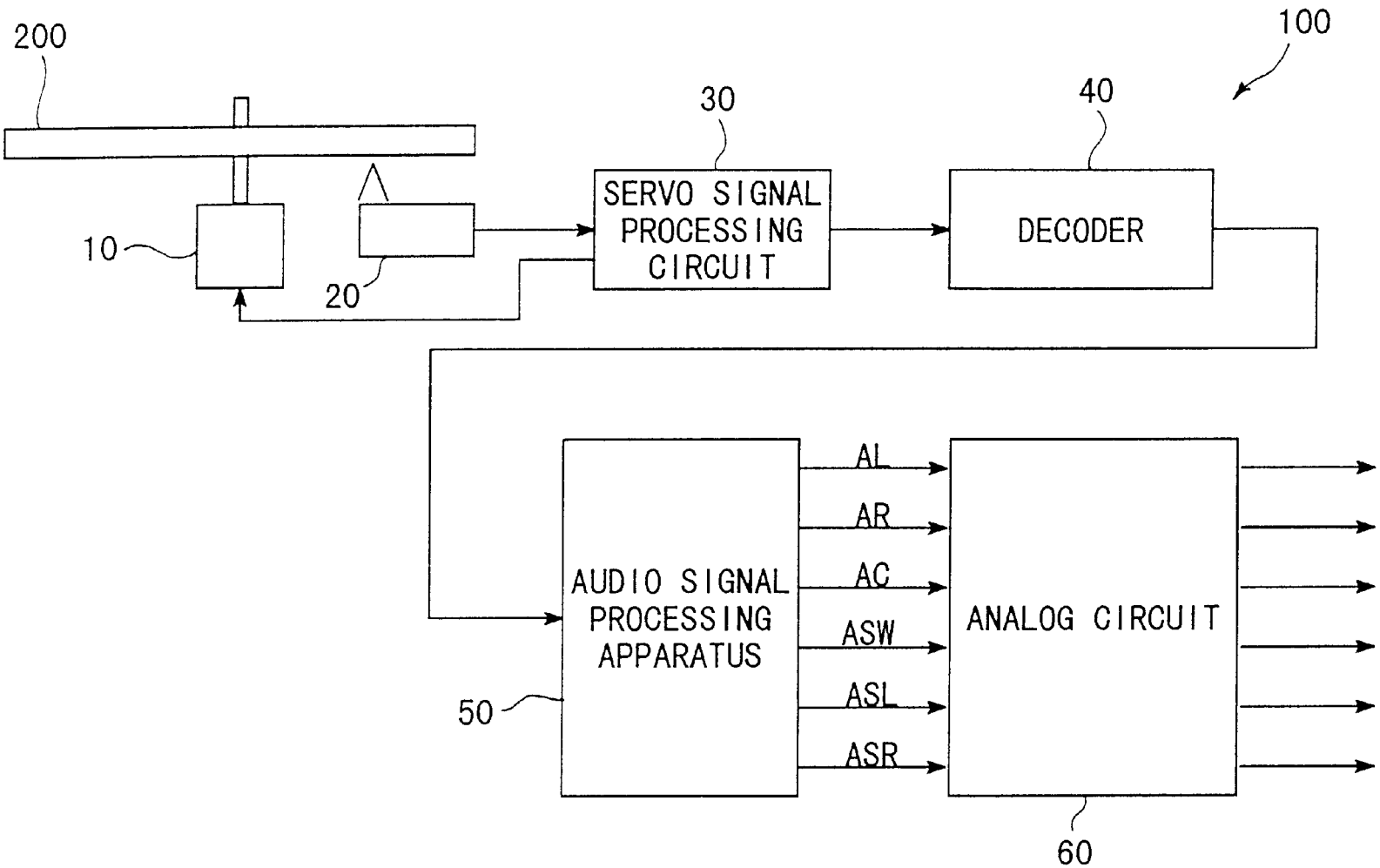
FIG. 1 is a block diagram showing a DVD reproduction system according to a first embodiment of the present invention.

FIG. 1 shows a DVD reproduction system 100 which adopts the multi channel audio reproduction method. As shown in FIG. 1, the DVD reproduction system 100 has: a spindle motor 10 for controlling rotation of a DVD 200; an optical pickup 20 for reading various digital information recorded on the DVD 200; a servo signal processing circuit 30 for extracting digital information with respect to sound or voice (Hereinafter, it is referred to as digital audio information.) and information with respect to control of the spindle motor 10 and so on (Hereinafter, it is referred to as control information.) from among digital information read from the DVD 200; a decoder 40 for decoding the digital audio information extracted by the servo signal processing circuit 30; an audio signal processing apparatus 50 for converting the digital audio information decoded by the decoder 40 into analog audio signals; and an analog circuit 60 for amplifying the analog audio signals converted by the audio signal processing apparatus 50 and performing other analog signal processing necessary for delivering the analog audio signals to audio output devices or speakers (not shown). According to the DVD reproduction system 100 having such a construction, the audio information such as music, sound of movies or motion pictures and so on can be reproduced.

Next, the audio signal processing apparatus 50 installed in the DVD reproduction system 100 is explained with reference to FIG. 2.

Figure 2:
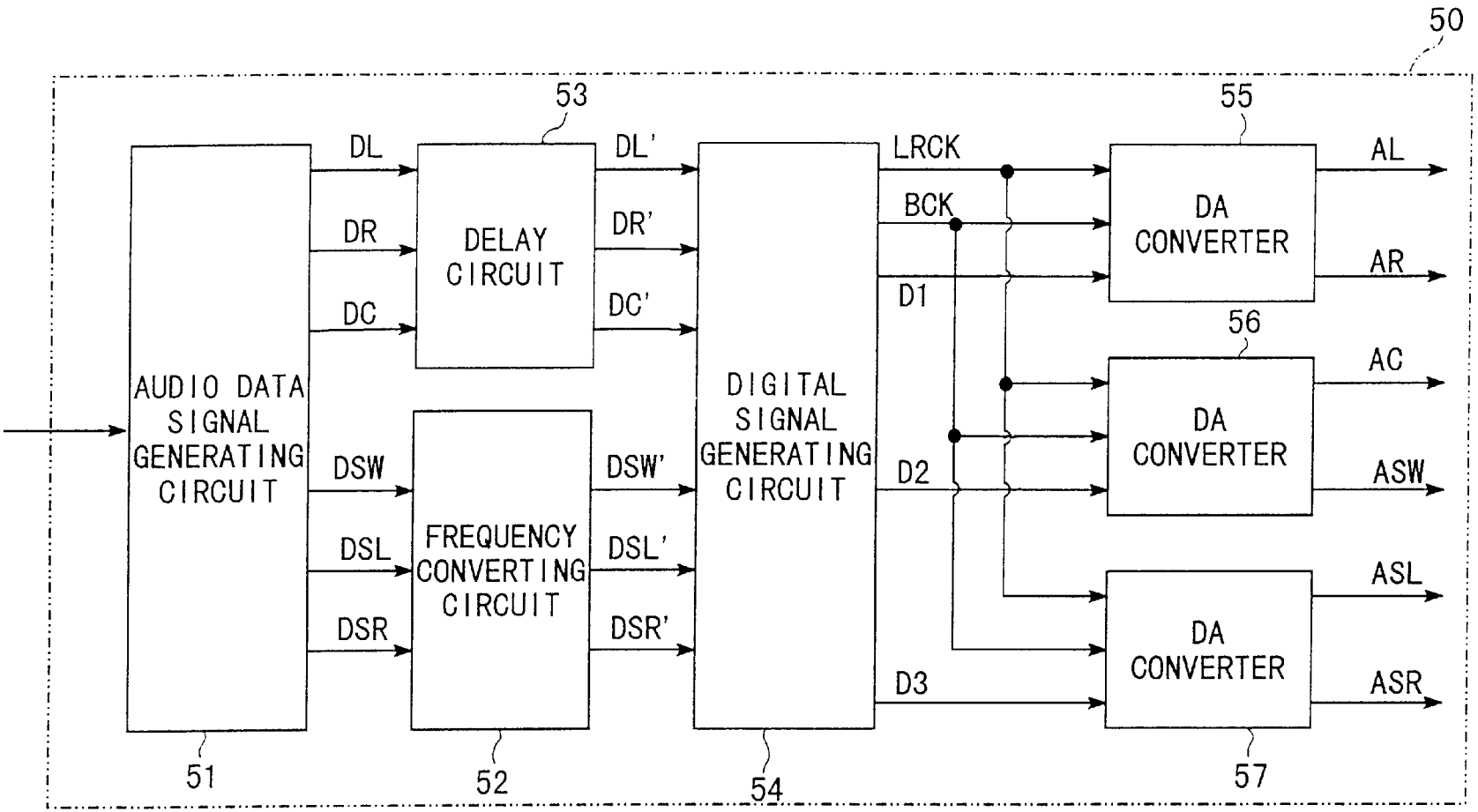
FIG. 2 is a block diagram showing an audio signal processing apparatus of the DVD reproduction system according to the first embodiment of the present invention.

FIG. 2 shows the audio signal processing apparatus 50 installed in the DVD reproduction system 100. As shown in FIG. 2, the audio signal processing apparatus 50 has: an audio data signal generating circuit 51, a frequency converting circuit 52, a delay circuit 53, a digital signal generating circuit 54 and three digital-to-analog converters 55, 56 and 57 (Hereinafter, it is referred to as DA converters 55, 56 and 57.).

The audio data signal generating circuit 51 receives the digital audio information from the decoder 40 shown in FIG. 1, and generates six audio data signals DL, DR, DC, DSW, DSL and DSR on the basis of the received digital information. Each of the six audio data signals DL, DR, DC, DSW, DSL and DSR is audio information formed by a pulse code modulation method (PCM), for example. Furthermore, among the six audio data signals, three audio data signals DL, DR and DC have the sampling frequency of 96 kHz, and three audio data signals DSW, DSL and DSR have the sampling frequency of 48 kHz.

The frequency converting circuit 52 receives the audio data signals DSW, DSL and DSR from the audio data signal generating circuit 51, and converts the sampling frequency of each of the audio data signals DSW, DSL and DSR into the same sampling frequency as that of each of the audio data signals DL, DR and DC. Namely, the frequency converting circuit 52 converts the audio data signals DSW, DSL and DSR each having the sampling frequency of 48 kHz into the audio data signals DSW', DSL' and DSR' each having the sampling frequency of 96 kHz, respectively. Furthermore, the frequency converting circuit 52 feeds the audio data signals DSW', DSL' and DSR' into the digital signal processing circuit 54.

The delay circuit 53 receives the audio data signals DL, DR and DC from the audio data signal generating circuit 51, delays the received audio data signals DL, DR and DC by a time period necessary for the converting operation in the frequency converting circuit 52, and feeds the delayed audio data signals DL, DR and DC into the digital signal generating circuit 54 as audio data signals DL', DR' and DC'. Namely, the delay circuit 53 delays the audio data signals DL, DR and DC so as to set the audio data signals DL', DR', DC', DSW', DSL' and DSR' in phase. Therefore, the audio data signals DL', DR', DC', DSW', DSL' and DSR' are fed into the digital signal generating circuit 54 in phase.

The digital signal generating circuit 54 receives the audio data signals DL', DR' and DC' from the delay circuit 53 and the audio data signals DSW', DSL' and DSR' from the frequency converting circuit 52.

The audio data signals DL', DR' and DC' have the sampling frequency of 96 kHz, and also, the audio data signals DSW', DSL' and DSR' have the sampling frequency of 96 kHz. Thus, the sampling frequencies of all the six audio data signals DL', DR', DC', DSW', DSL' and DSR' are the same at the stage that these audio data signals are fed into the digital signal generation circuit 54.

The digital signal generating circuit 54 generates a channel clock signal LRCK, a bit clock signal BCK and three digital audio signals D1, D2 and D3 on the basis of the audio signals DL', DR', DC', DSW', DSL' and DSR', and feeds these generated signals into the DA converters 55, 56 and 57.

More concretely, the digital signal generating circuit 54 generates the digital audio signal D1 by mixing the audio data signal DL' and the audio data signal DR' by using a time division multiplex method. The digital signal generating circuit 54 also generates the digital audio signal D2 by mixing the audio data signal DC' and the audio data signal DSW' by using the time division multiplex method. The digital signal generating circuit 54 further generates the digital audio signal D3 by mixing the audio data signal DSL' and the audio data signal DSR' by using the time division multiplex method. In addition, the channel clock signal LRCK is a signal to be used for dividing each of the digital audio signals D1, D2 and D3 into two components. Moreover, the bit clock signal BCK indicates the length of each data included in each of the digital audio signals D1, D2 and D3.

The DA converters 55, 56 and 57 convert the digital audio signals D1, D2 and D3 into six analog audio signals AL, AR, AC, ASW, ASL and ASR, respectively, on the basis of the channel clock signal LRCK and the bit clock signal BCK, and feeds these analog audio signals into the analog circuit 60 shown in FIG. 1.

Each of the DA converters 55, 56 and 57 is a so called dual channel type DA converter. Namely, the DA converter 55 receives the digital audio signal D1 including two components corresponding to the audio data signals DL' and DR' by the time division multiplex method, performs a time-dividing operation to divide the received digital audio signal D1 into the two components on the basis of the channel clock signal LRCK and the bit clock signal BCK, and performs a digital-to-analog converting operation to convert the two components into the two analog audio signals AL and AR. Similarly, the DA converter 56 converts the digital audio signal D2 into the two analog audio signals AC and ASW on the basis of the channel clock LRCK and the bit clock BCK. Further, the DA converter 57 converts the digital audio signal D3 into the two analog audio signals ASL and ASR on the basis of the cannel clock LRCK and the bit clock BCK.

The analog audio signals AL, AR, AC, ASW, ASL and ASR are fed into the analog circuit 60, and delivered from the analog circuit 60 to the six audio output devices or the six speakers, respectively. For example, the analog audio signal AL is delivered to the speaker located at the left front. The analog audio signal AR is delivered to the speaker located at the right front. The analog audio signal AC is delivered to the speaker located at the center front. The analog audio signal ASW is delivered to the speaker located at the center back. The analog audio signal ASL is delivered to the speaker located at the left back. The analog audio signal ASR is delivered to the speaker located at the right back. Thus, the multi channel reproduction of six channels is realized.

As described above, the audio signal processing apparatus 50 of the present invention makes the sampling frequencies of all the six audio data signals DL, DR, DC, DSW, DSL and DSR uniform by converting the sampling frequency of each of the audio data signals DSW, DSL and DSR. Therefore, the audio data signals DL', DR', DC', DSL', DSR' and DSW' each having the same sampling frequency are applied to the digital signal generating circuit 54, and the digital audio signals D1, D2 and D3 each having the same sampling frequency are applied to the DA converters 55, 56 and 57, respectively.

Since the sampling frequencies of all the digital audio signals D1, D2 and D3 are uniform, it is possible to convert all the digital audio signals D1, D2 and D3 by using only one kind of DA converter. That is, since the sampling frequencies of all the digital audio signals D1, D2 and D3 are set at 96 kHz, it is possible to convert all the digital audio signals D1, D2 and D3 by using only one kind of DA converter designed for converting digital signals having the sampling frequency of 96 kHz. Consequently, efficiency of use of the DA converters can be improved as high as possible. Therefore, according to the audio signal processing apparatus 50 of the present invention, it is possible to reduce the number of DA converters and realize simple structure and low manufacturing cost, while enhancing the sound quality.

If both of three audio data signals each having the sampling frequency of 96 kHz and three audio data signals each having the sampling frequency of 48 kHz are directly delivered to the respective six speakers, two kinds of DA converters are required. Namely, a DA converter to be used for converting the audio data signal having the sampling frequency of 96 kHz and a DA converter to be used for converting the audio data signal having the sampling frequency of 48 kHz are required. In this case, if dual channel type DA converters are used, four dual channel type DA converts are required. Namely, two dual channel type DA converters to be used for converting the three audio data signals each having the sampling frequency of 96 kHz and two dual channel type DA converters to be used for converting the three audio data signal each having the sampling frequency of 48 kHz are required, because the dual channel type DA converter generally converts a set of two digital signals into a set of two analog signals. Thus, if the three audio data signals each having the sampling frequency of 96 kHz and the three audio data signals each having the sampling frequency of 48 kHz are directly delivered to the respective six speakers, efficiency of use of the DA converters goes down, and manufacturing cost is increased.

However, according to the audio signal processing apparatus 50 of the present invention, the three audio data signals DSW, DSL and DSR each having the sampling frequency of 48 kHz are converted into the three audio data signals DSW', DSL' and DSR' each having the sampling frequency of 96 kHz, and the six audio data signals DL', DR', DC', DSW', DSL' and DSR' each having the same sampling frequency of 96 kHz are delivered to the respective six speakers. Therefore, the six audio data signals DL', DR', DC', DSW', DSL' and DSR' can be converted by using only one kind of DA converter. Actually, these signals can be converted by using only three dual channel type DA converters 55, 56 and 57. Therefore, the number of the dual channel type DA converters can be reduced, efficiency of use of the DA converters can be improved, and manufacturing cost can be reduced.

Further, according to the audio signal processing apparatus 50 of the present invention, since the digital audio signals are converted by using only one kind of DA converter, all the DA converters 55, 56 and 57 can be controlled by the common channel clock signal LRCK and the common bit clock signal BCK. As shown in FIG. 2, the common channel clock signal LRCK is applied to each of the DA converters 55, 56 and 57, and the common bit clock signal BCK is applied to each of the DA converters 55, 56 and 57. Therefore, the number of signal lines to be used for controlling the DA converters can be reduced, the arrangement of the signal lines can be simplified, and the structure of the audio signal processing apparatus 50 can be simplified.

Moreover, according to the audio signal processing apparatus 50 of the present invention, since the sampling frequency of each of the audio data signals DSW, DSL and DSR is increased from 48 kHz to 96 kHz, it is possible to improve signal to noise ratio of audio data signals DSW, DSL and DSR by noise shaping.

Next, an audio signal processing apparatus of a second embodiment of the present invention is explained with reference to FIGS. 3 and 4. In addition, in FIG. 3, the same constructional elements as those in FIG. 2 carry the same reference numbers and explanations with respect to these elements are omitted.

Figure 3:
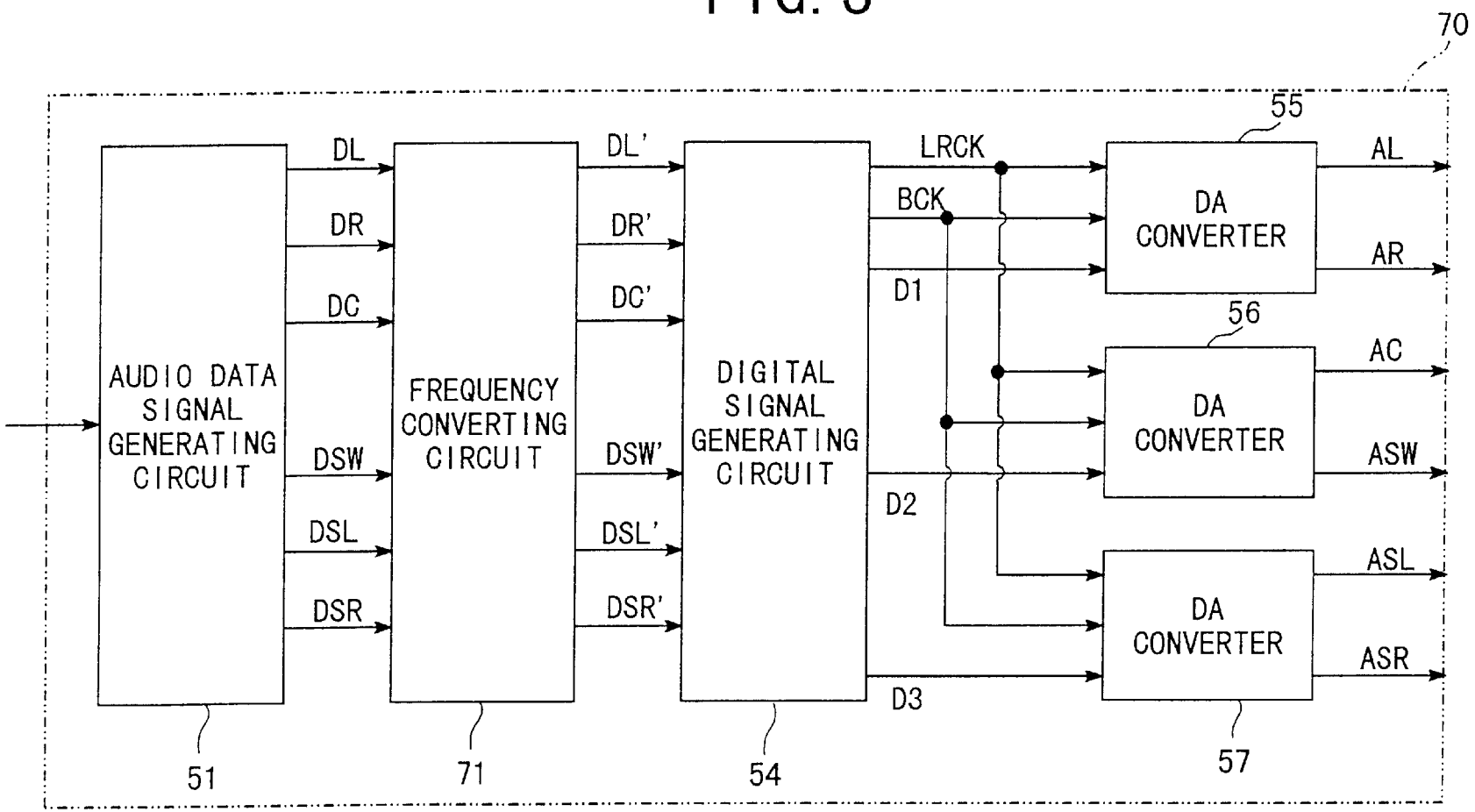
FIG. 3 is a block diagram showing an audio signal processing apparatus of a DVD reproduction system according to a second embodiment of the present invention.

FIG. 3 shows an audio signal processing apparatus 70 installed in a DVD reproduction apparatus according to the second embodiment of the present invention. Compared with the audio signal processing apparatus 50 shown in FIG. 2, the audio signal processing apparatus 70 shown in FIG. 3 is different with respect to a frequency converting circuit 71. The frequency converting circuit 71 installed in the audio signal processing apparatus 70 receives all the audio data signals DL, DR, DC, DSW, DSL and DSR from the audio data signal generating circuit 51.

Figure 4:
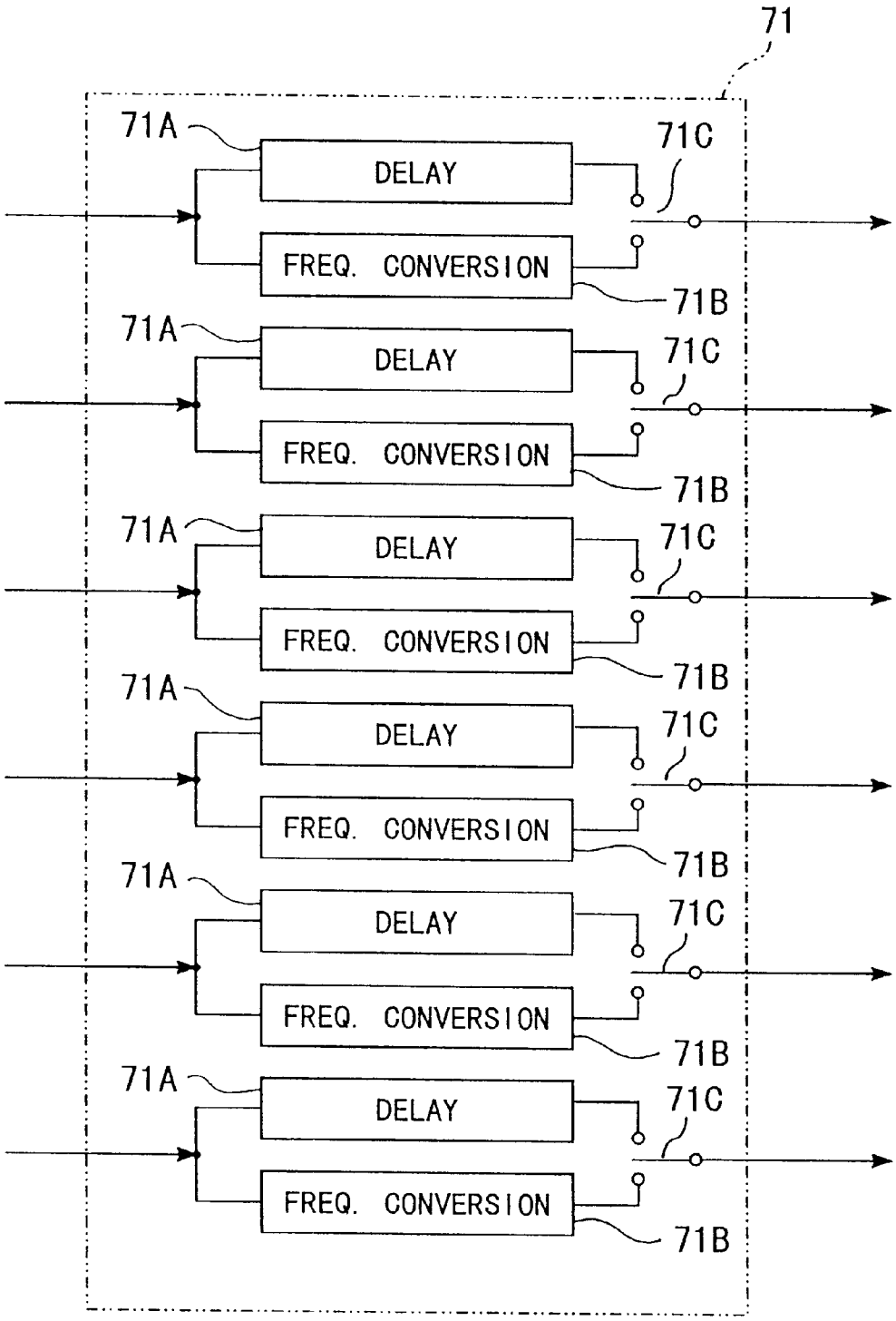
FIG. 4 is a block diagram showing a frequency converting circuit according to the second embodiment of the present invention.

As shown in FIG. 4, the frequency converting circuit 71 has six sections each having: a delay portion 71A; a frequency converting portion 71B which is arranged in parallel with the delay portion 71A; and a switch 71C.

The frequency converting circuit 71 converts the sampling frequencies of the audio data signals DSW, DSL and DSR by the frequency converting portions 71B. The frequency converting circuit 71 converts the sampling frequency of each of the audio data signals DSW, DSL and DSR into the same sampling frequency as that of each of the audio data signals DL, DR and DC. That is to say, the frequency converting circuit 71 converts the audio data signals DSW, DSL and DSL each having the sampling frequency of 48 kHz into the audio data signals DSW', DSL' and DSR' each having the sampling frequency of 96 kHz, and feeds the audio data signals DSW', DSL' and DSR' into the digital signal generating circuit 54.

Further, the frequency converting circuit 71 delays the audio data signals DL, DR and DC by the delay portions 71A. The frequency converting circuit 71 delays the audio data signals DL, DR and DC by a time period necessary for converting the sampling frequencies of the audio data signals DSW, DSL and DSR, in order to set all the audio signals DL, DR, DC, DSW, DSL and DSR in phase. The delayed audio data signals DL, DR and DC are fed into the digital signal generating circuit 54 as audio data signals DL', DR' and DC'.

More concretely, as shown in FIG. 4, the audio data signals DL, DR, DC, DSW, DSL and DSR are actually fed into both of the delay portions 71A and the frequency converting portions 71B, respectively. If the audio data signals DL, DR and DC are fed into the delay portions 71A and the frequency converting portions 71B, the switches 71C operate so as to connect the output of the delay portions 71A with the digital signal generating circuit 54. On the other hand, if the audio data signals DSW, DSL and DSR are fed into the delay portions 71A and the frequency converting portions 71B, the switches 71C operate so as to connect the output of the frequency converting portions 71B with the digital signal generating circuit 54.

Thus, according to the audio signal processing apparatus 70 of the second embodiment, it is possible to obtain the similar advantages as the audio signal processing apparatus 50 of the first embodiment.

Furthermore, according to the frequency converting circuit 71, the output of the delay portion 71A and the output of the frequency converting portion 71B can be easily switched over by the switch 71C. Therefore, it is possible to easily change from the delaying operation to the converting operation and from the converting operation to the delaying operation for each input signals. Consequently, the audio signal processing apparatus 70 has high flexibility.

In addition, the audio data signal generating circuit 51, the frequency converting circuit 52 (71), the delay circuit 53 and the digital signal generating circuit 54 may be embodied in independent chips, respectively. Alternatively, the audio data signal generating circuit 51, the frequency converting circuit 52 (71), the delay circuit 53 and the digital signal generating circuit 54 may be embodied in an integrated circuit on one chip. Moreover, these circuits may be embodied in software having the same functions as these circuits.

Furthermore, the aforementioned audio signal processing apparatus 50 (70) has six channels. However, the number of channels is not limited. The present invention can be adapted for the audio signal processing apparatus having two, three, four, five or more than six channels.

Moreover, in the aforementioned audio signal processing apparatus 50 (70), the frequency converting circuit 52 (71) converts the sampling frequency of each of the three audio data signals form 48 kHz to 96 kHz in order to set the sampling frequencies of all the six audio data signals at 96 kHz. However, the present invention is not limited to this. For example, the sampling frequency each of the three audio data signals may be converted from 96 kHz to 48 kHz in order to set the sampling frequencies of all the six audio data signals at 48 kHz.

Moreover, the aforementioned audio signal processing apparatus 50 (70) processes the audio data signals each having the sampling frequency of 48 kHz or 96 kHz. However, the value of the sampling frequency is not limited. For example, the audio data signals having the sampling frequency of 32 kHz, 44.1 kHz, etc. can be processed.

Moreover, in the aforementioned audio signal processing apparatus 50 (70), the dual channel type DA converters are used. However, the present invention is not limited to this. Single channel type DA converters, triple channel type DA converters or other multi channel type DA converters can be used. Especially, according to the present invention, it is possible to simplify the structure of the audio signal processing apparatus in case that a pre-packaged DA converter chip on which a plurality of single channel type DA converters or other multi channel type DA converters are integrated is used. Of course, the DA converters are not limited to the pre-packaged chip. The DA converters can be built into a circuit together with the audio data signal generating circuit 51, the frequency converting circuit 52 (71), the delay circuit 53 and the digital signal generating circuit 54.

Figure 5:
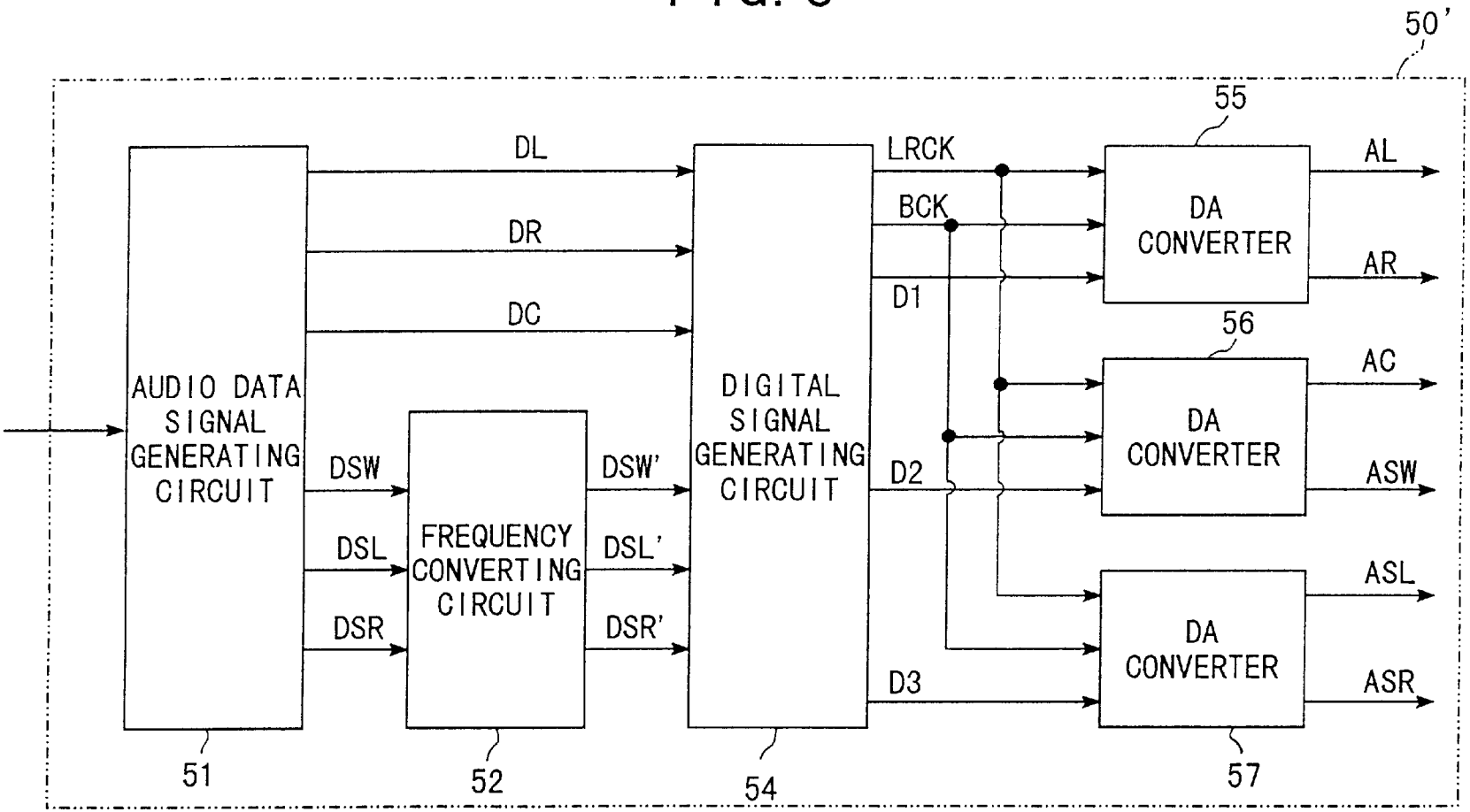
FIG. 5 is a block diagram showing a modified audio signal processing apparatus based on the audio signal processing apparatus according to the first embodiment of the present invention.

In addition, in the aforementioned audio signal processing apparatus 50 (70), the delay circuit 53 (delay portions 71A) is installed in order to set the audio data signals to be applied to the digital signal generating circuit 54 in phase. However, as shown in FIG. 5, the delay circuit 53 (delay portions 71A) can be removed. For example, there is no delay circuit between the audio data signal generating circuit 51 and the digital signal generating circuit 54 in an audio signal processing apparatus 50'. The audio data signals DL, DR and DC are directly applied from the audio data signal generating circuit 51 to the audio signal generating circuit 54. In such an apparatus 50', it is possible to reproduce the sound and simplify the structure.

Moreover, the aforementioned audio signal processing apparatus 50 (70) is used in the DVD reproduction system 100. However, the present invention is not limited to this. The audio signal processing apparatus can be used in other reproduction system, such as a CD (Compact Disk) reproduction system.

Figure 6:
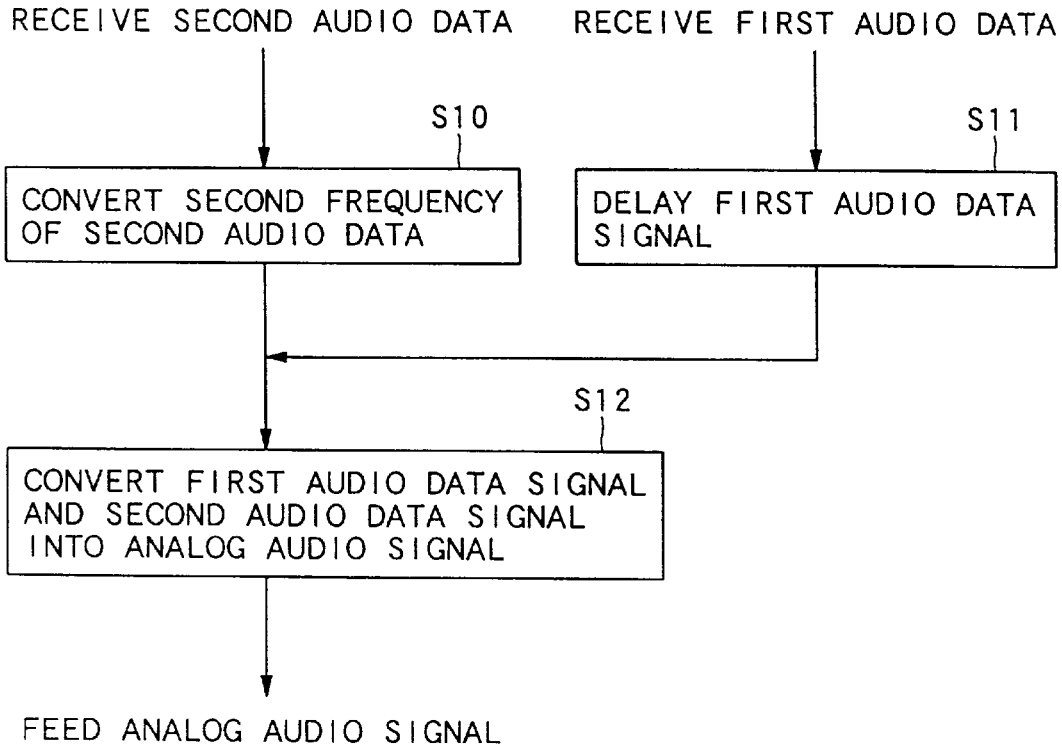
FIG. 6 is a flow diagram showing a process for performing digital-to-analog conversion according to the first and second embodiments of the invention.

FIG. 6 is a flow diagram showing a process for performing digital-to-analog conversion according to the above mentioned embodiments of the present invention.

The frequency converting circuit converts at least a second sampling frequency of a second audio data signal into the same frequency as a first sampling frequency of a first audio data signal (S10). The delay circuit delays the first audio data signal by a time period necessary to convert the second sampling frequency of the second audio data signal into the same sampling frequency as the first sampling frequency (S11). The DA converters convert the first audio data signal having the first sampling frequency and the second audio data signal having the converted second sampling frequency into the analog audio signals, respectively (S12).

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

The entire disclosure of Japanese Patent Application No. 9-212946 filed on Aug. 7, 1997 including the specification, claims, drawings and summary is incorporated herein by reference in its entirety.

What is claimed is:

1. An audio signal processing apparatus for performing digital-to-analog conversion to convert at least a first audio data signal having a first sampling frequency and a second audio data signal having a second sampling frequency which is different from said first sampling frequency into corresponding analog audio signals, respectively, said audio signal processing apparatus comprising:

a frequency converting device for converting said second sampling frequency of said second audio data signal into the same sampling frequency as said first sampling frequency; and a digital-to-analog converting device for performing digital-to-analog conversion to convert said first audio data signal having said first sampling frequency and said second audio data signal having said converted second sampling frequency into said analog audio signals, respectively.

2. An audio signal processing apparatus according to claim 1, further comprising a delay device for delaying said first audio data signal by a time period necessary for said frequency converting device to convert said second sampling frequency of said second audio data signal into the same sampling frequency as said first sampling frequency.

3. An audio signal processing apparatus according to claim 1, wherein said first sampling frequency is higher than said second sampling frequency, and said frequency converting device raises said second sampling frequency to the same sampling frequency as said first sampling frequency.

4. An audio signal processing apparatus according to claim 1, wherein said digital-to-analog converting device comprises:

a control signal generating device for generating a control signal which indicates a length of each data included in each of said first audio data signal and said second audio data signal; and a digital-to-analog converter for performing digital-to-analog conversion to convert said first audio data signal and said second audio data signal into said analog audio signals, respectively, on the basis of said control signal.

5. An audio signal processing apparatus according to claim 1, wherein said digital-to-analog converting device comprises:

a digital signal generating device for generating a digital signal by mixing said first audio data signal and said second audio data signal and generating a control signal which includes information to divide said digital signal into two components each corresponding to respective one of said first audio data signal and said second audio data signal; and a digital-to-analog converter for dividing said digital signal into said two components on the basis of said control signal and performing digital-to-analog conversion to convert said two components into said analog audio signals, respectively.

6. An audio signal processing apparatus used in a multi channel audio reproduction system for performing digital-to-analog conversion to convert at least a plurality of first audio data signals each having a first sampling frequency and a plurality of second audio data signals each having a second sampling frequency which is different from said first sampling frequency into corresponding analog audio signals, respectively, and delivering said analog audio signals to a plurality of audio output device, respectively, said audio signal processing apparatus comprising:

a frequency converting device for converting said second sampling frequency of each of said second audio data signals into the same sampling frequency as said first sampling frequency; and a digital-to-analog converting device for performing digital-to-analog conversion to convert said first audio data signals each having said first sampling frequency and said second audio data signals each having said converted second sampling frequency into said analog audio signals, respectively.

7. An audio signal processing apparatus according to claim 6, further comprising a delay device for delaying said each of first audio data signals by a time period necessary for said frequency converting device to convert said second sampling frequency of each of said second audio data signals into the same sampling frequency as said first sampling frequency.

8. An audio signal processing method of performing digital-to-analog conversion to convert at least a first audio data signal having a first sampling frequency and a second audio data signal having a second sampling frequency which is different from said first sampling frequency into corresponding analog audio signals, respectively, said audio signal processing method comprising the processes of:

converting said second sampling frequency of said second audio data signal into the same sampling frequency as said first sampling frequency; and performing digital-to-analog conversion to convert said first audio data signal having said first sampling frequency and said second audio data signal having said converted second sampling frequency into said analog audio signals, respectively.

9. An audio signal processing method according to claim 8, further comprising the process of delaying said first audio data signal by a time period necessary to convert said second sampling frequency of said second audio data signal into the same sampling frequency as said first sampling frequency.

10. An audio signal processing method according to claim 8, wherein said first sampling frequency is higher than said second sampling frequency, and said second sampling frequency is increased to the same sampling frequency as said first sampling frequency in said frequency converting process.

* * * * *